United States Patent [19]

Shinomiya

[11] 3,948,385

[45] Apr. 6, 1976

[54] APPARATUS FOR INVERTING A SHEET MEMBER

[75] Inventor: Tsutomu Shinomiya, Iwatsuki, Japan

[73] Assignee: Kabushiki Kaisha Tomoku, Otaru, Japan

[22] Filed: Mar. 18, 1975

[21] Appl. No.: 559,658

[30] Foreign Application Priority Data

Aug. 29, 1974 Japan ..... 49-102754

[52] U.S. Cl. ..... 198/237; 198/244; 214/1 Q; 271/66; 271/83; 271/186

[51] Int. Cl.[2] ..... B65G 47/24

[58] Field of Search ..... 198/237, 244, 245; 214/1 Q, 1 QA, 1 QG, 1 S; 271/186, 66, 72, 83

[56] References Cited

UNITED STATES PATENTS 230,962 8/1880 Perkins ..... 271/83

FOREIGN PATENTS OR APPLICATIONS 1,195,481 6/1965 Germany ..... 271/66

*Primary Examiner*—Evon C. Blunk
*Assistant Examiner*—Douglas D. Watts
*Attorney, Agent, or Firm*—Haseltine, Lake & Waters

[57] ABSTRACT

An apparatus for inverting a sheet member comprising a pair of spaced conveyors cooperatively defining a conveyor passage along which a sheet member can be advanced, and a rotatable arm assembly mounted between the conveyors and including upper and lower arms defining an opening therebetween, adapted for receiving the sheet member from the upstream conveyor and conveying the sheet member to the downstream conveyor. The arms continue rotating back to the initial position after depositing the sheet on the downstream conveyor. The arms are driven at a non-uniform speed and accelerate from the initial position to an upright position and then decelerate from the upright position to the position adjacent the downstream conveyor. The upper arm includes a swingable clamp which rotates in a direction opposite to the direction of rotation of the arm when going from the initial position to the upright position, and which rotates in the same direction as the arms when they go from the upright position to the position adjacent the downstream conveyor. After the release of the sheet material to the downstream conveyor, the rotatable supporting shaft of the arm is lowered to a position below the conveyors and the arms continue rotating back to the initial position, whereby successively fed sheet members can be alternately inverted.

10 Claims, 7 Drawing Figures

APPARATUS FOR INVERTING A SHEET MEMBER

FIELD OF THE INVENTION

This invention relates to apparatus for turning over a sheet member such as a board, a plate or the like.

A sheet member, for instance, a sheet of corrugated cardboard obtained by cutting a long strip of material wound off from a rolled sheet is liable to be warped after the cutting, and therefore it is usual to obviate such warpage in that a number of such obtained sheet members are alternatively inverted and stacked upon one another.

PRIOR ART

A reversing apparatus hitherto used for the above purpose is shown in FIG. 7 and has a construction in which an arm member *e* having upper and lower arms *d* defining a U-shaped opening *c* therebetween is mounted midway along a conveying passage *b* for a sheet member *a*. The member *e* is rotatable about shaft *f*, and it operates in such manner that a sheet member *a* is periodically supplied into the opening *c* and is reversed by rotation of the arm member *e*. The arm member *e* rotates, with its opening *c* directed upwards, in the direction as shown by the arrow and, after sheet member *a* is reversed, the arm member *e* continues to rotate with its opening *c* directed downwards. The shaft *f* is thereafter lowered below the surface of the conveying passage *b* by any suitable means, whereby the next supplied sheet member is allowed to pass thereover without being reversed. Thus, a reversed and a non-reversed sheet member *a* are alternately fed to the downstream side of the conveying passage *b*. In this operation, the rotational speed of the arm member *e* is such that it is comparatively low at a position where the opening *c* is nearly parallel with the conveying passage *b* so that the sheet member *a* may be easily fed in and out of the opening *c*, but it is comparatively high at a position where the opening *c* is nearly perpendicular to the conveying passage *b* so that the operational efficiency may be improved. When, however, the arm member *e* rotates with such irregular speed, there is brought about a difference in inertia between the arm member *e* and the sheet member *a*, and the disadvantage occurs that when the arm member *e* comes into its deceleration stage, the sheet member *a* becomes inclined within the opening *c* by the inertia thereof as shown clearly in FIG. 7 and the sheet strikes against the upper end of the lower arm *d* and is damaged thereby.

SUMMARY OF THE INVENTION

An object of the present invention is to provide a construction which obviates the above disadvantage and specifically which avoids objectionable striking of the sheets against the upper end of the lower arm.

Another object of the invention is to obviate the above disadvantage by imparting an acceleration to the sheet member at the time when the arm member is in its deceleration stage, so as to counteract the inertia effect of the sheet member.

In accordance with the above and further objects of the invention, there is provided an apparatus for inverting a sheet member comprising means defining a conveyor passage along which a sheet member can be advanced, a rotatable arm assembly mounted along said passage and including upper and lower arms defining an opening therebetween adapted for receiving said sheet member, means for rotating said arms 360° at a non-uniform speed from an initial position in which said opening faces upstream of said passage back to a coincident final position, said arms passing through an upright position and a position in which said opening faces downstream of said passage, said upper arm including a swingable clamp means for rotating in a direction opposite to the direction of rotation of said arms when going from said initial position to said upright position and for rotating in the same direction as said arms when going from said upright position to the position in which said opening faces downstream.

In further accordance with the invention, it is contemplated that said clamp means comprises a clamp arm pivotably mounted relative to said upper arm, and cylinder means coupled to the lower arm and to said clamp arm for pivotably moving said clamp arm relative to said upper arm.

In further accordance with the invention, said means which rotates said arms acts to accelerate the arms in going from the initial position towards said upright position and to decelerate the arms in going from said upright position to the position in which said opening faces downstream, said clamp means clamping the sheet against the lower arm during the acceleration stage and releasing the sheet while traveling away from said lower arm during the deceleration stage.

DETAILED DESCRIPTION

Figure 1:
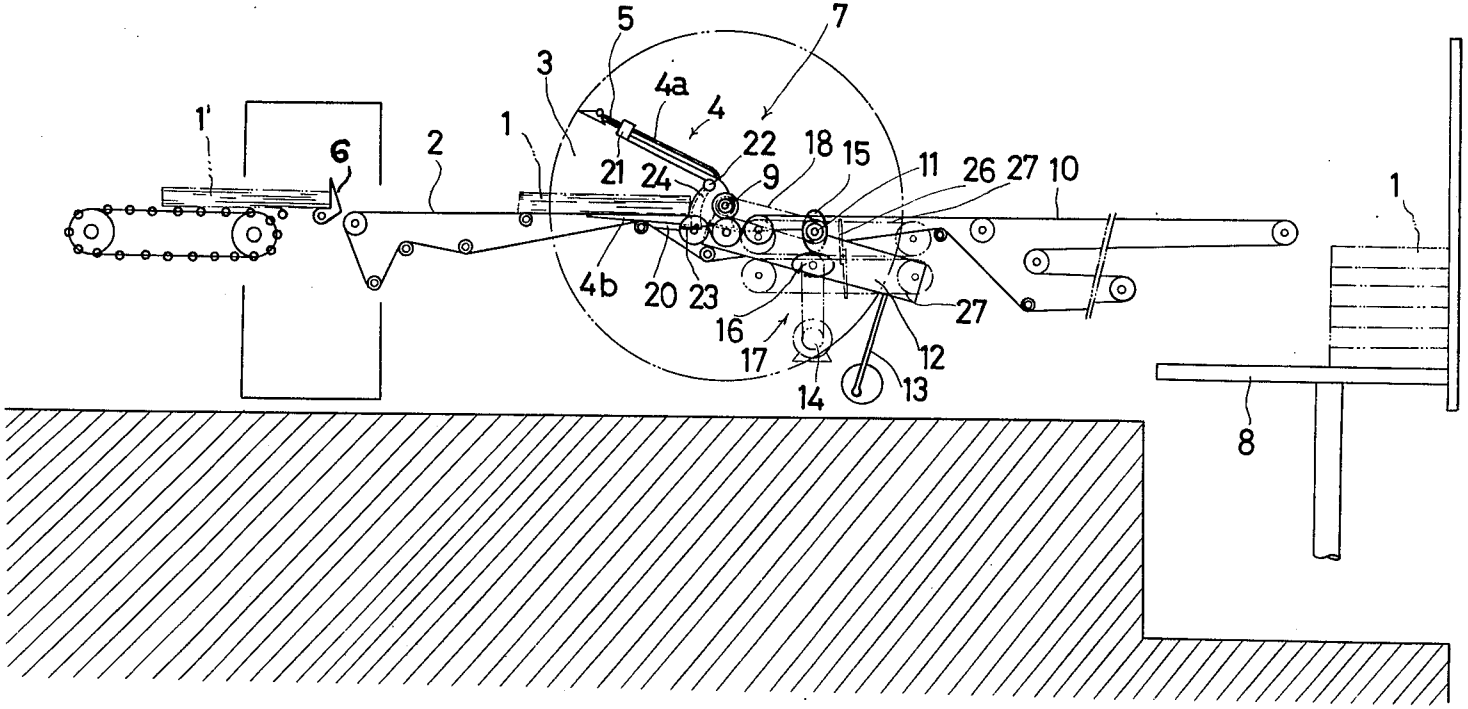
FIG. 1 is a side elevation view of a complete assembly of one embodiment according to the invention.

Referring to FIG. 1, therein is seen a conveyor or passage 2 for a sheet member 1 formed by an upstream conveyor and a downstream conveyor, and a rotatable arm member assembly 4 is mounted along conveyor passage 2 and has upper and lower arms 4*a*, 4*b* defining a U-shaped opening 3 therebetween, the arm member assembly 4 rotating in one direction at a non-uniform speed so that the opening 3 may turn 360° from a position facing towards the upstream side of the conveyor passage 2 to once again face towards the upstream side, the member 4 passing through positions facing upwardly and towards the downstream side. This arrangement so far is the same as in the prior art.

According to the invention, the upper arm 4*a* includes a swingable clamp arm 5 so arranged that when the arm member assembly 4 rotates from the upstream side to the upright position, the clamp arm 5 swings in a direction opposite to the direction of rotation of assembly 4 whereas when the assembly 4 rotates from the upright position to the position facing downstream, the clamp arm 5 swings in the same direction as the direction of rotation of assembly 4.

The sheet member 1, which is in the form of a pile of several sheets in the illustrated embodiment, can be obtained by stacking several sheets of corrugated cardboard wound off from respective rolls and cutting the stack by a suitable cutting means (not illustrated). The pile of sheets of sheet member 1 is fed by a separator 6 to the upstream conveyor of the conveyor passage 2, and the stack is turned over in reversing apparatus 7 constructed, as mentioned above, from the rotatable arm assembly 4 and associated elements, the reversing apparatus 7 being provided at the midway position along the conveying passage 2. Thus, the sheet members 1, 1' . . . supplied one after another may be alternately turned over by the reversing apparatus 7 and these sheet members 1, 1' . . . are then placed on one another in an alternately reversed relationship on a stacking apparatus 8 so that the warped sheet members can be corrected by the weight of the stacked sheet members themselves.

The rotatable arm assembly 4 is attached to a supporting shaft 9 extending transversely of the conveyor passage 2, and belt 10 constituting the downstream conveyor of the conveyor passage 2 is wound to make a detour with respect to the supporting shaft 9 to pass below the same. The supporting shaft 9 is fixed to a swingable frame 12 which is pivotable about a shaft 11 and a connecting rod 13 is connected to one end of the frame 12, so that when the connecting rod 13 is pushed upwards, the supporting shaft 9 descends below the surface of the conveyor passage 2, whereby the sheet member 1' is allowed to pass thereover without being reversed, as will be explained later. The arm member assembly 4 is driven in rotation with the pivoting of the supporting shaft 9, and for this purpose a change-speed mechanism 17 comprising a pair of oval gears 15, 16 in mesh with one another is interposed between the supporting shaft 9 and an electric drive motor 14 for driving the shaft, respective chains 18, 19 being engaged between the supporting shaft 9 and the oval gear 15 and between the electric motor 14 and the oval gear 16. Thus, the arm member assembly 4 is rotated rapidly when the opening 3 thereof is directed upwards and downwards, but the arm member assembly 4 rotates slowly when the opening 3 is directed nearly horizontally.

Numeral 20 denotes a cylinder mounted on the lower arm **4*b*, numeral 21 denotes a limit abutment for restricting the swinging movement of the clamp arm 5, numeral 22 denotes a shaft connecting the limit abutment 21 and the clamp arm 5, and a rod 23 extending from the cylinder 20 is connected to an extension arm 24 of the clamp arm 5, so that by extending the rod 23 the clamp arm 5 can be pivoted within the opening 3 in the direction of arrow 25**.

Figure 2:
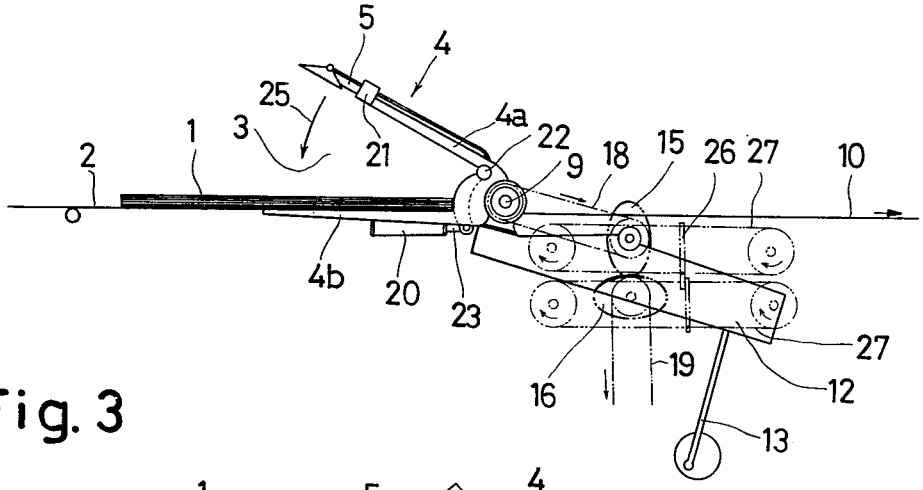
FIGS. 2 to 6 show portions of such assembly in different positions to illustrate the operation of the embodiment.
Figure 3:
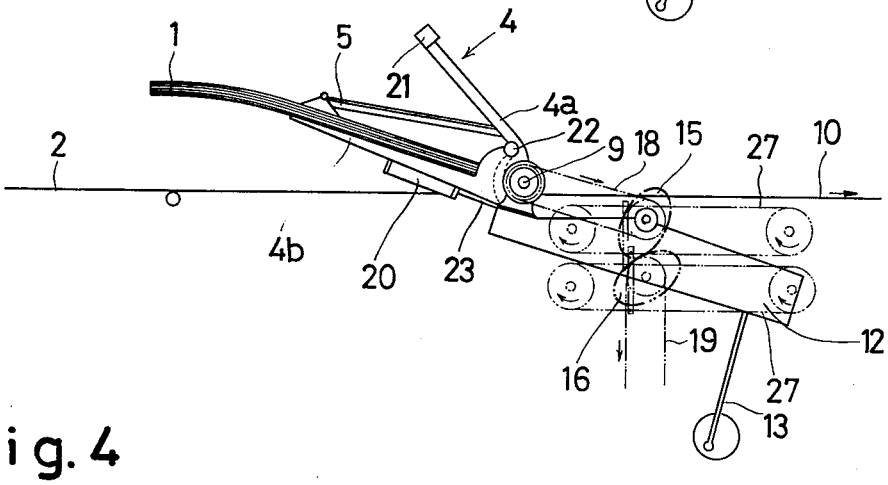
Figure 4:
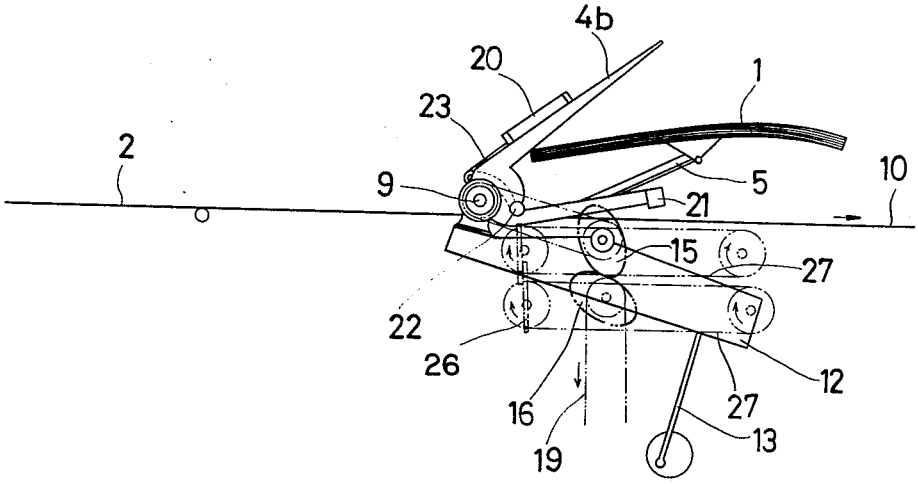
Figure 5:
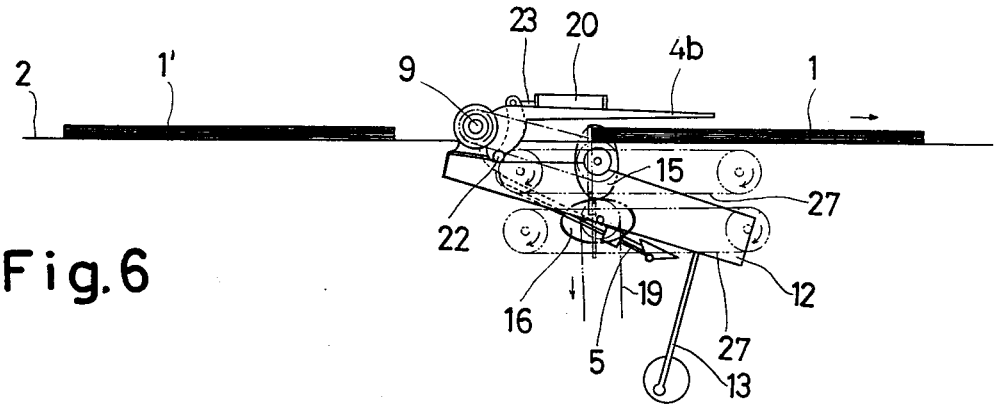
Figure 7:
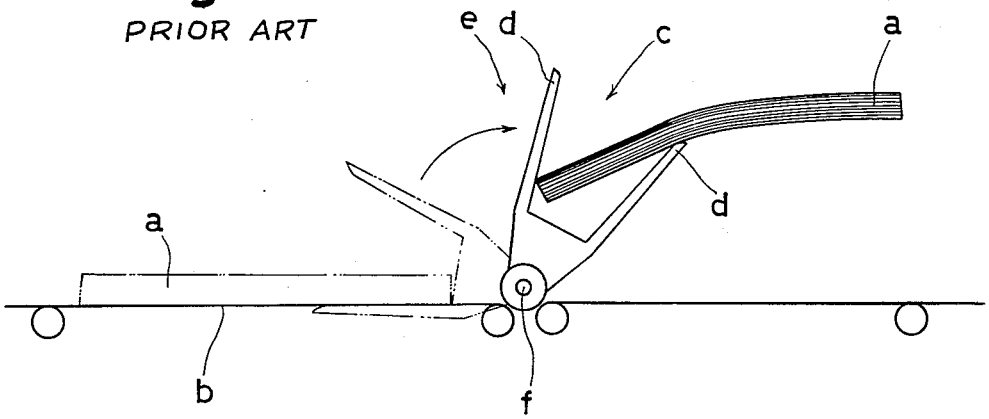
Fig. 7 PRIOR ART
FIG. 7 is a side view of a conventional embodiment of the prior art.

The sheet members 1, 1' . . . are sent by the separating apparatus 6 to the conveyor passage 2, one after the other in a suitably spaced relationship and the first sheet 1 is sent into the opening 3 directed towards the upstream side of the arm member assembly 4 of the reversing apparatus 7, as shown in FIG. 2. Since the arm member assembly 4 rotates at a comparatively low speed in the position in which the opening 3 is directed towards the upstream side, due to the operation of the change-speed mechanism 17, the sheet member 1 can be positively received therein. When this receiving is detected by a suitable detecting means (not illustrated), the cylinder 20 is operated to swing the clamp arm 5 in the direction of the arrow 25, as shown in FIG. 3, whereby the sheet member 1 is clamped between the clamp arm 5 and the lower arm **4*a*. During this period, the arm member assembly 4 travels towards the upright position while its speed of rotation is increased. When arm 4 reaches the position as shown in FIG. 4, the speed of rotation has slowed down. The length of time during which the arm member 4 rotates from its upwardly directed position to its horizontally directed position, that is, the length of time from the highest speed to the lowest speed is extremely short, and therefore a large inertia force acts on the sheet member 1. It is often the case in the conventional arrangement as explained before with reference to FIG. 7, that the sheet member 1 strikes against the arm 4 by the inertia and is damaged. In the apparatus according to the invention, however, as the arm member assembly 4 comes into its deceleration stage, the cylinder 20 is contracted by a signal from a suitable indication means (not illustrated), and thereby minimizes the inertia of the sheet member 1 caused by the deceleration of the arm member 4. Further, the clamp arm 5 is swung in the direction of inertia action, that is, in the same direction as the direction of rotation of the arm member assembly 4 as shown in FIG. 4. Then the sheet member 1, thus reversed, is placed on the downstream conveyor passage 2 as shown in FIG. 5, and a pusher member 26 projects upwards from below the conveyor passage 2, thereby to forcedly discharge the sheet member 1 towards the downstream discharge end at a speed higher than the conveying speed of the conveyor passage 2. Numeral 27 denotes a pair of upper and lower endless belts rotating synchronously with the rotation of the arm member assembly 4 and the pusher member 26 is attached to extend across the belts 27**.

Figure 6:
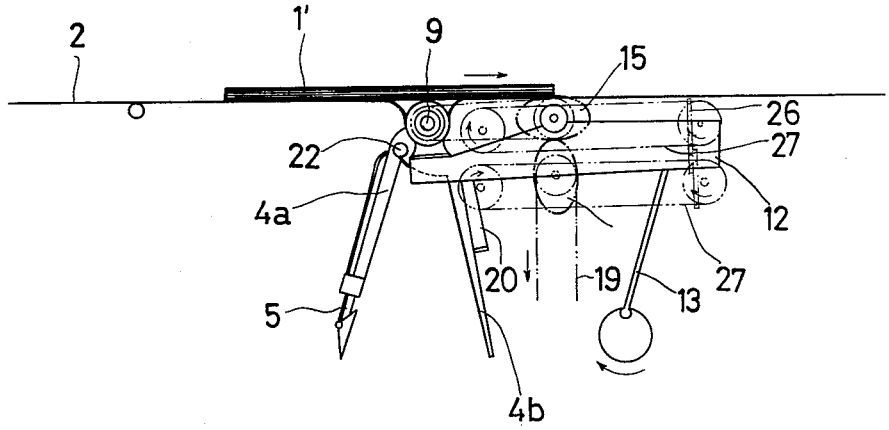

When the arm member assembly 4 finishes reversing the sheet member 1 and reaches the position shown in FIG. 6, the swingable frame 12 is pivoted to cause the supporting shaft 9 of the arm member assembly to descend below the surface of the conveyor passage 2, and thus the next sheet 1' is allowed to pass thereover without being reversed.

Accordingly, when the above operation is repeated, the sheet member 1 is reversed and the sheet member 1' is not reversed and these are alternately discharged at the downstream end and therefore when they are placed upon one another in this order on the stacking apparatus 8; the sheet members 1, 1' are placed upon one another in an alternately reversed relationship and the warped ones can be corrected by their own weights.

Thus, according to this invention, the arm member assembly 4 arranged to rotate at a non-uniform speed is provided with the clamp arm 5 which swings in reverse direction to the rotating direction of the arm member 4 during the acceleration stage thereof and swings in the reverse direction during the deceleration stage thereof, so that the sheet member can be reversed without being damaged.

What is claimed is:

1. Apparatus for inverting a sheet member comprising means defining a conveyor passage along which a sheet member can be advanced, a rotatable arm assembly mounted along said passage and including upper and lower arms defining an opening therebetween adapted for receiving said sheet member, means for rotating said arms 360° at a non-uniform speed from an initial position in which said opening faces upstream of said passage back to a coincident final position, said arms passing through an upright position and a position in which said opening faces downstream of said passage, said upper arm including a swingable clamp means for rotating in a direction opposite to the direction of rotation of said arms when going from said initial position to said upright position and for rotating in the same direction as said arms when going from said upright position to the position in which said opening faces downstream.

2. Apparatus as claimed in claim 1 wherein said upper arm includes abutment means for limiting the swinging movement of said clamp means.

3. Apparatus as claimed in claim 1 wherein said means for rotating said arms comprises a drive motor, and a change-speed mechanism drivingly coupling said drive motor and said arms, said change-speed mechanism including a pair of oval gears in mesh with one another.

4. Apparatus as claimed in claim 1 wherein said clamp means comprises a clamp arm pivotably mounted relative to said upper arm, and cylinder means coupled to the lower arm and to said clamp arm for pivotably moving said clamp arm relative to said upper arm.

5. Apparatus as claimed in claim 4 wherein said clamp arm includes an extension portion to which said cylinder means is attached.

6. Apparatus as claimed in claim 1 wherein said means which rotates said arms acts to accelerate the arms in going from the initial position towards said upright position and to decelerate the arms in going from said upright position to the position in which said opening faces downwardly, said clamp means clamping the sheet against the lower arm during the acceleration stage and releasing the sheet while traveling away from said lower arm during the deceleration stage.

7. Apparatus as claimed in claim 4 wherein said upper arm includes a portion fixed to said lower arm, said clamp arm being pivotably mounted on said portion.

8. Apparatus as claimed in claim 7 comprising a shaft rotatably supporting said lower arm and said portion of the upper arm for rotation about an axis transverse to said conveyor passage.

9. Apparatus as claimed in claim 8 comprising means for lowering said shaft below said conveyor passage during the time when the said arms are rotated from the position in which said opening faces downstream back to said initial position.

10. Apparatus as claimed in claim 9 comprising means for accelerating the advancement of the sheet member on said conveyor passage downstream of said axis.

* * * * *